United States Patent [19]

Adams

[11] Patent Number: 4,665,868

[45] Date of Patent: May 19, 1987

[54] DIFFERENTIAL PISTON AND VALVING SYSTEM FOR DETONATION DEVICE

[75] Inventor: Joseph S. Adams, Whistler, Canada

[73] Assignee: Joseph Adams Technical Arts Ltd., Canada

[21] Appl. No.: 703,821

[22] Filed: Feb. 21, 1985

[51] Int. Cl.[4] ..... F01B 71/00

[52] U.S. Cl. ..... 123/46 SC; 123/292

[58] Field of Search ..... 123/50, 292, 46 R, 46 A, 123/46 SC

[56] References Cited

U.S. PATENT DOCUMENTS

| | | | |
|---|---|---|---|
| 957,017 | 5/1910 | Vanderlip | 123/50 R |
| 1,653,825 | 12/1927 | Salves | 123/274 |
| 3,042,008 | 7/1962 | Liesse | 123/46 SC |
| 4,365,471 | 12/1982 | Adams | 60/39.76 |
| 4,377,991 | 3/1983 | Liesse | 123/46 SC |

FOREIGN PATENT DOCUMENTS

| | | | |
|---|---|---|---|
| 418370 | 12/1910 | France | 123/292 |
| 50465 | 7/1919 | Sweden | 123/292 |

*Primary Examiner*—Craig R. Feinberg

*Attorney, Agent, or Firm*—Stonebraker, Shepard & Stephens

[57] ABSTRACT

A purging and recharging system improves the repeating of detonations from a detonation device 10 having a detonation chamber 20 separated from an ignition chamber 25 by a detonation plate 22 having an opening 23 through which a flame jet can pass from ignition chamber 25 to detonation chamber 20. A differential piston 30 driven by a detonation in a differential cylinder 31, 32 around detonation chamber 20 affords a fluid passageway between differential piston 30 and detonation chamber 20. On a power stroke, differential piston 30 compresses recharging air and draws in cooling and exhaust purging air to surround detonation chamber 20. On a return stroke, differential piston 30 forces cooling and purging air into detonation chamber 20 and then admits compressed recharging air into detonation chamber 20. A check valve 55 on the detonation side of the opening in detonation plate 22 admits fluid and flame from ignition chamber 25 into detonation chamber 20 during ignition and blocks backflow of fluid or flame from detonation chamber 20 into ignition chamber 25 during detonation.

7 Claims, 4 Drawing Figures

DIFFERENTIAL PISTON AND VALVING SYSTEM FOR DETONATION DEVICE

BACKGROUND

This invention improves on detonation devices for rapidly burning a charge of fuel and air. My previous U.S. Pat. No. 4,365,471, COMPRESSIOM WAVE FORMER, proposed such a detonation device suitable for the improvements of this invention.

My present invention increases the power output by making a detonation more efficient and provides a purging and recharging system enabling detonations to be repeated rapidly and indefinitely. These improvements also are not limited to detonation devices of the type suggested in my earlier U.S. Pat. No. 4,365,471.

SUMMARY OF THE INVENTION

My invention serves as a purging and recharging system for a repeating detonation device having a detonation chamber separated from an ignition chamber by a detonation plate having an opening through which a flame jet can pass from the ignition chamber to the detonation chamber. I use a differential piston driven by a detonation and arranged in a differential cylinder around the detonation chamber to afford a fluid passageway between the differential piston and the detonation chamber. The differential piston on a power stroke compresses recharging air and draws in cooling and exhaust purging air to surround the detonation chamber. On a return stroke, the differential piston forces cooling and purging air into the detonation chamber and then admits compressed recharging air to the detonation chamber. A check valve on a detonation side of the opening in the detonation plate admits fluid and flame from the ignition chamber into the detonation chamber during ignition and blocks backflow of fluid or flame from the detonation chamber into the ignition chamber during detonation.

DRAWINGS

Figure 1:
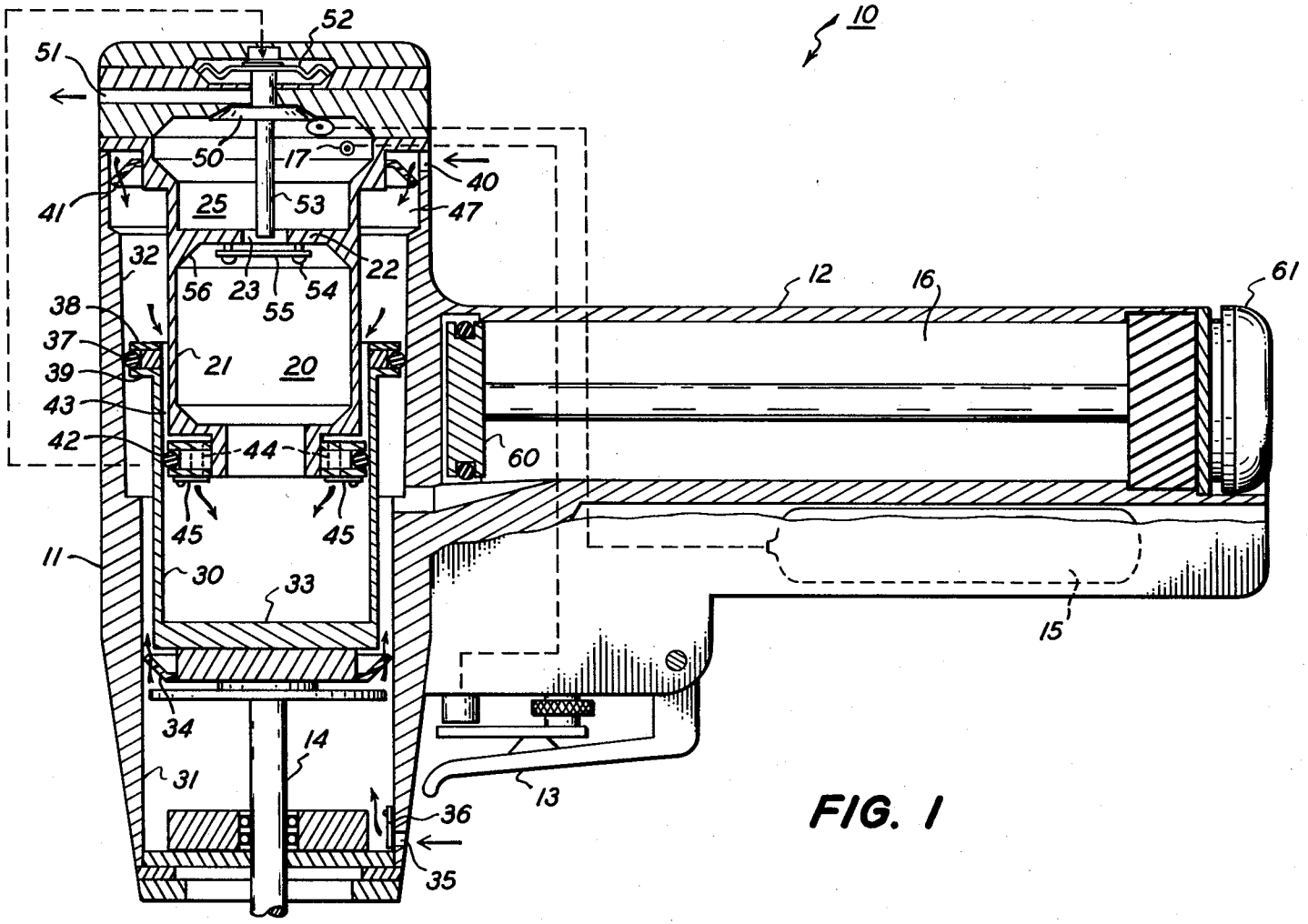
Figure 2:
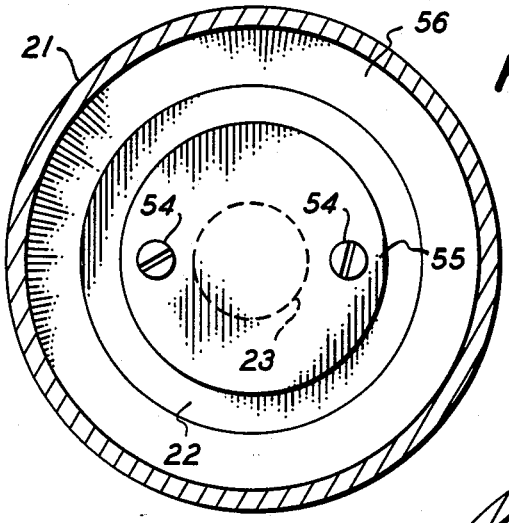
Figure 3:
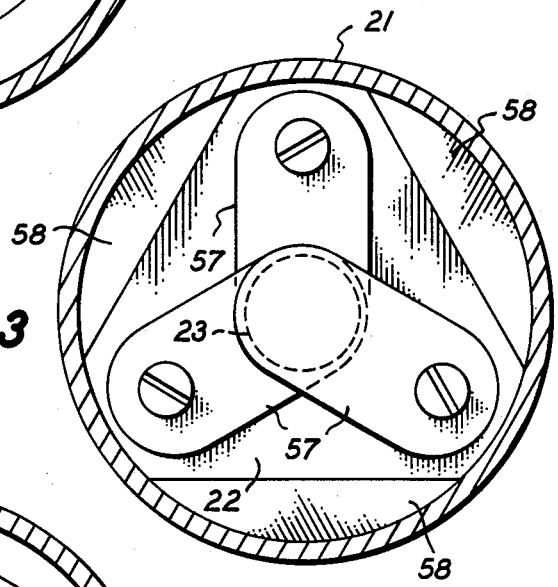
Figure 4:
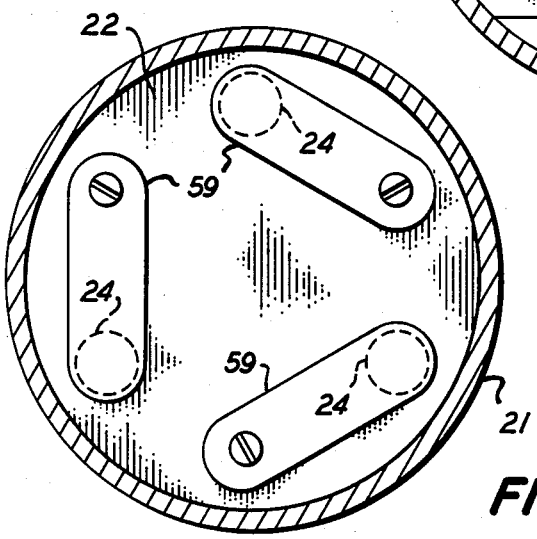

FIG. 1 is a partially schematic, elevational, cross-sectional view of a preferred embodiment of my invention as applied to a hand-operated fastener driving tool; and FIGS. 2–4 are enlarged bottom views of a detonation plate suitable for the device of FIG. 1 and showing alternative preferred check valve arrangements.

DETAILED DESCRIFTION

Tool 10, as shown in FIG. 1, is a hand-held fastener driving tool that conveniently illustrates a preferred way of applying my invention to a practical purpose. However, my invention is not limited to fastener tools and applies to detonation devices used for other purposes.

A detonation in detonation chamber 20 of device 10 is accomplished by an ignition chamber 25 as explained more fully below. But for some fuels and some circumstances, a detonation in chamber 20 can be initiated by a spark or flame not produced by ignition chamber 25.

Tool 10 has a housing 11, a handle 12, a trigger 13, a fastener driver 14, and a fuel supply 15, all of which are schematically or partially illustrated as conventional components of a fastener driving tool. My improvement lies in a purging and recharging system using a differential piston 30 and associated valving and passageways that cooperate to accomplish effective purging and recharging for rapidly repeating detonations of improved efficiency.

Differential piston 30 is a free piston and moves in a differential cylinder having a smaller bore 31 and a larger bore 32. Differential piston 30 also includes upstanding sidewalls forming a cylinder, as it were, within the piston. This inner cylinder or expansion chamber surrounds and is spaced from the wall 21 of detonation chamber 20. An inside bottom surface 33 of differential piston 30 forms a power piston that is driven downward by a detonation from chamber 20.

A one-way seal 4 around an outer surface of differential piston 30 moves in smaller cylinder 31 to operate as a pump piston. Air is admitted to smaller cylinder 31 via an opening 5 covered by a one-way check valve 36 that lets air flow into cylinder 31 and blocks air outflow. As pump seal 34 moves downward on a power stroke, air in smaller cylinder 31 is compressed and escapes past seal 34 toward a plenum 16 in handle 12 where the compressed air is stored for recharging purposes. On a return stroke, as differential piston 30 moves upward, pump seal 4 draws more air into smaller cylinder 31 via passageway 35 and check valve 36.

At the upper end of differential piston 30, a seal 37 runs in larger cylinder 32. Above seal 37 is a displacer piston 38, and below seal 37 is a return piston 39. When differential piston 30 is moving downward on a power stroke, displacer 38 draws in purging air via an air inlet opening 40 and a one-way seal 41. This purging air is drawn into larger cylinder 32 around the outside of detonation chamber wall 21 where it absorbs some heat transmitted through wall 21.

A seal 42 engaging the inside of differential piston 30 operates with seal 37 around the outside of differential piston 30 so that purging air drawn into larger bore 32 on a power stroke of differential piston 30 is pumped into detonation chamber 20 on a return stroke. This is possible because of a fluid flow passageway 43 formed between chamber wall 21 and the inside of differential piston 30 and passageways 44 arranged inside of seal 42 and having check valves 45.

A return stroke of differential piston 30 is caused partly by a vacuum that occurs after a detonation in chamber 20 and partly by recharging air that is compressed in plenum 16 during a power stroke. The compressed recharging air exerts force on return piston 39 to lift differential piston 30 to its uppermost position where seal 37 enters into port 47 and disengages from larger cylinder 32. This opens a passageway around seal 37 and over displacer piston 38 so that compressed recharging air flows around seal 37 in port 47 and follows the purging air down through passageway 43, passages 44, and check valves 45 to flow into detonation chamber 20. Such an arrangement also allows the compressed recharging air to fill chamber 20 with air at more than atmospheric pressure, which can substantially increase the force of a detonation.

An exhaust system cooperates with differential piston 30 for exhausting burnt gases and some of the purging air to keep chamber 20 adequately cool, fully exhausted, and fully recharged with fresh air. Exhaust valve 50 controls an exhaust passageway 51 and is operated by a diaphragm 52 that is subject to the pressure of the compressed recharging all in plenum 16 as shown by the broken line arrow. I have found it desirable to open exhaust valve 50 rapidly at the end of a power stroke so as to vent exhaust gases and residual heat as quickly as possible. Using the rising pressure of the recharging air that is compressed in plenum 16 on a power stroke to open exhaust valve 50 toward the end of a power stroke accomplishes this.

When exhaust valve 50 opens, a pin 53 extending downward from exhaust valve 50 opens a check valve 55 covering opening 23 in detonation plate 22. This opens an exhaust route through valve 55, opening 23, ignition chamber 25, and exhaust passageway 51, venting both detonation chamber 20 and ignition chamber 25 to exhaust.

Check valve 55 is loosely mounted on screws 54 and blocks any backflow of fluid or flame from detonation chamber 20 through opening 23 during a detonation. This improves the force and efficiency of a detonation, although I do not yet fully understand why. One possibility is that ignition in chamber 25 forces some unburned fuel/air mixture into detonation chamber 20 ahead of a flame jet injected through opening 23. Then when the flame jet detonates the fuel/air mixture in detonation chamber 20, the force of the detonation slams check valve 55 closed over opening 23, trapping all the available fuel and air in chamber 20 for a more forceful detonation. Also, blocking any escape route through detonation plate 22 by the closure of check valve 55 forces the full detonation energy through the output from chamber 20 against power piston surface 33.

Another function of check valve 55 is to divert a flame jet from ignition chamber 25 through opening 23 so that the flame spreads radially outward along detonation plate 22 toward the periphery of detonation chamber 20. There, a deflector surface 56 directs the radially spreading flame axially of detonation chamber 20 for an effective ignition.

An alternative check valve arrangement as shown in FIG. 3 uses three reed valves 57 overlapping each other and covering opening 23 in detonation plate 22. Reed valves 57 not only cooperate to serve as check valves over opening 23, but also divide an incoming flame jet into three radial segments flowing in the spaces between reed valves 57 and deflected axially of detonation chamber 20 by peripheral deflector surfaces 58.

Another reed check valve arrangement for detonation plate 22 as shown in FIG. 4 uses three reed valves 59 covering three openings 24 formed around the periphery of detonation plate 22. As reed valves 59 are forced open by flames injecting into the detonation chamber through openings 24, reed valves 59 deflect each flame jet from an axial path and make the flame jets swirl helically around the periphery of detonation chamber 20 for a fast and effective initiation of a detonation. Reed valves 59 also check any backflow of fuel or flame through openings 24 during a detonation.

Piston 60 can be moved in handle 12 by knob 61 for manually pumping up the pressure of recharging air in plenum 16 for an initial detonation after which detonations can be repeated automatically and indefinitely. Air enters through opening 35 and check valve 36 as this occurs.

Trigger 13 delivers a spark to spark plug 17 in ignition chamber 25 as schematically shown by a broken line arrow. An arrangement not shown injects fuel from container 15 into ignition chamber 25, also as schematically shown by a broken line arrow.

The purging and recharging accomplished by differential piston 30 and its associated valves and passageways assures that adequate air is forced through detonation chamber 20 and ignition chamber 25 to purge exhaust gases and prevent heat build-up. The rapid action of the exhaust system in response to compressed recharging air cooperates to help make this possible. The recharging air pumped in by differential piston 30 and compressed during a power stroke also provides piston return force and ensures an adequate volume of recharging air, which can be compressed above atmospheric pressure to improve performance in detonation chamber 20. Fuel injection and spark ignition then ready tool 10 for an automatically repeatable detonation. Check valving the flame injection opening through detonation plate 22 not only cooperates with the exhaust system, but also increases the force of a detonation. This cooperates with the purging and recharging system to produce a large driving force from a small detonation chamber to increase the efficiency of the device.

I claim:

1. A purging and recharging system for a repeating detonation device having a detonation chamber separated from an ignition chamber by a detonation plate having an opening through which a flame jet can pass from said ignition chamber into said detonation chamber, said system comprising:

a. a differential cylinder surrounding said detonation chamber with an annular space therebetween;

b. a differential free piston disposed for reciprocation within said differential cylinder, the top of said piston having upward sidewalls extending into said annular space and defining an expansion chamber directly communicating with said detonation chamber, via an opening formed in a bottom portion of said detonation chamber spaced inward from said sidewalls, and disposed for reciprocation relative to said detonation chamber, said sidewalls further affording a fluid passageway around the periphery of said detonation chamber, said free piston being driven by a detonation from said detonation chamber;

c. said differential free piston being arranged on a power stroke for drawing in cooling and exhaust purging air to surround said detonation chamber and for compressing recharging air;

d. said differential free piston being arranged on a return stroke for forcing said cooling and purging air into said detonation chamber and for admitting compressed recharging air to said detonation chamber; and e. a check valve arranged on the detonation side of said detonation plate over said opening to admit fluid and flame from said ignition chamber into said detonation chamber during ignition and to block backflow of fluid and flame from said detonation chamber into said ignition chamber during detonation.

2. The system of claim 1 wherein said check valve is arranged for diverting said flame from said ignition chamber toward a peripheral region of said detonation chamber.

3. The system of claim 1 wherein said differential free piston includes a power piston (33) cooperating with said detonation chamber and driven by a detonation in said detonation chamber, a pump piston (34) for pumping recharging air into said system, a return piston (39) cooperating with said differential cylinder for returning said differential piston in response to force of said compressed recharging air, and a displacer piston (38) for drawing in said cooling and exhaust purging air.

4. The system of claim 1 including an exhaust valve (50) communicating with said ignition chamber, a diaphragm (52) controlling the opening of said exhaust valve, and means for communicating said compressed recharging air with said diaphragm for controlling said exhaust valve.

5. In a detonation device having an ignition chamber and a detonation chamber separated from said ingition chamber by a detonation plate having a plurality of openings each permitting the passage of fluid and flame from said ignition chamber into said detonation chamber, an improvement comprising:

a. said openings being arranged around a peripheral region of said detonation plate;

b. check valving arranged on solely on a side of said detonation plate facing of said detonation chamber downstream of said openings; and c. said check valving being arranged to admit fluid and flame from said ignition chamber through said openings in a swirling flow around a peripheral region of said detonation chamber during ignition and to block backflow of fluid and flame from said detonation chamber through said openings to said ignition chamber during detonation.

6. The improvement of claim 5 wherein said check valving includes a separate check valve over each of said openings.

7. The improvement of claim 5 wherein said check valving is arranged for diverting said fluid and flame radially of said detonation plate.

* * * * *